US005465838A

United States Patent [19]

Hollander et al.

[11] Patent Number: 5,465,838

[45] Date of Patent: Nov. 14, 1995

[54] PROTECTIVE IDENTIFYING SHIELD AND PROTECTED INSTRUMENT CASE

[75] Inventors: Milton B. Hollander, Stamford; David R. Jacobs, Norwalk; Janice E. Angrave, Stamford, all of Conn.

[73] Assignee: Omega Engineering, Inc., Stamford, Conn.

[21] Appl. No.: 24,936

[22] Filed: Mar. 2, 1993

[51] Int. Cl.[6] ..... B65D 85/38

[52] U.S. Cl. ..... 206/305; 206/523; 206/588; 206/592

[58] Field of Search ..... 206/305, 320, 206/521, 523, 586, 590, 592, 594, 588

[56] References Cited

U.S. PATENT DOCUMENTS

| | | | |
|---|---|---|---|
| 3,113,667 | 12/1963 | Knapp et al. | 206/588 X |
| 3,384,221 | 5/1968 | Houtman | 206/523 |
| 3,404,826 | 10/1968 | Carmody | 206/523 |
| 3,467,245 | 9/1969 | Kawamada | 206/523 X |
| 3,565,243 | 2/1971 | Freemer | 206/523 |
| 3,848,735 | 11/1974 | McGee et al. | 206/523 X |
| 3,854,650 | 12/1979 | Hanaue | 206/523 X |
| 3,938,661 | 2/1976 | Carmody | 206/599 X |
| 4,759,446 | 7/1988 | Dobashi et al. | 206/586 |
| 4,824,059 | 4/1989 | Butler | 206/592 X |
| 5,148,920 | 9/1992 | Walker | 206/588 |

FOREIGN PATENT DOCUMENTS

| | | | |
|---|---|---|---|
| 1224493 | 3/1971 | United Kingdom | 206/586 |

*Primary Examiner*—Bryon P. Gehman

*Attorney, Agent, or Firm*—Bruce E. Hosmer; Howard S. Reiter

[57] ABSTRACT

An identifying shield for an electronic instrument housing is formed of elastically stretchable and deformable material. The shield elastically surrounds the periphery of the instrument housing adjacent to its front panel surface, and defines a central opening that exposes the front panel for viewing by an operator. A first portion of the shield defines the central opening overlying the front panel of the instrument housing, and a second portion extends rearwardly from the first portion defining a peripheral band that engages the periphery of the case along its sidewalls adjacent to the front panel. An inwardly extending flange projects from the rearward edges of the peripheral band to enhance frictional engagement with the underlying sidewall surfaces of the instrument housing. The inwardly extending flange may also serve to retain the shield on the housing and to provide sealing between the front panel and the housing by being clamped between the front panel and the forward edges of the sidewalls of the housing. The shield material is resilient and elastically stretchable, so that it can be stretch-fitted over a housing in elastically gripping relationship; the thickness of the shield is selected so that unintended impacts with the outer surface of the shield will be absorbed in part in the shield and will be transmitted in part to the abutting surface of a support panel in which the housing is mounted.

17 Claims, 4 Drawing Sheets

FIG. 1
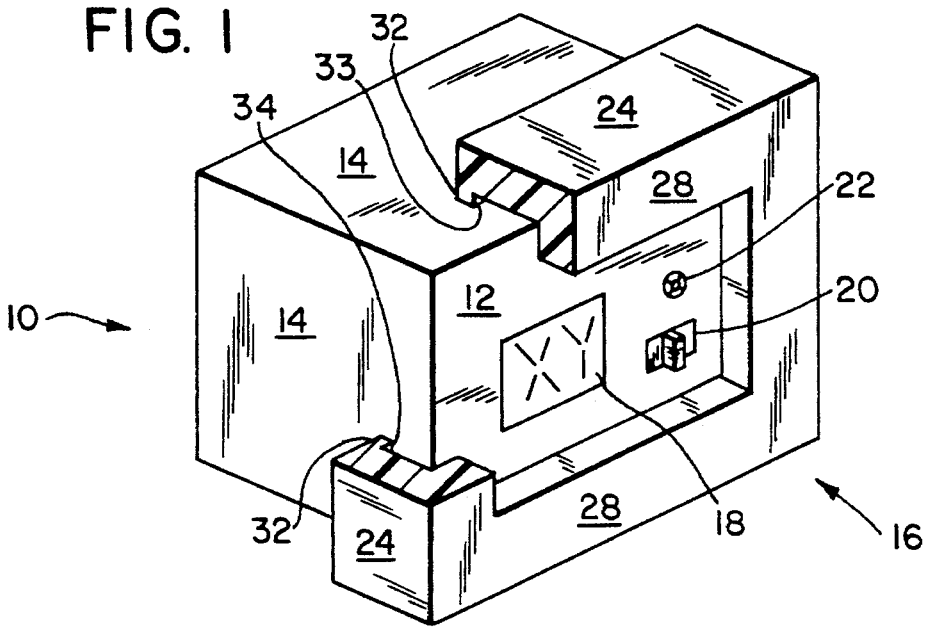
FIG. 2
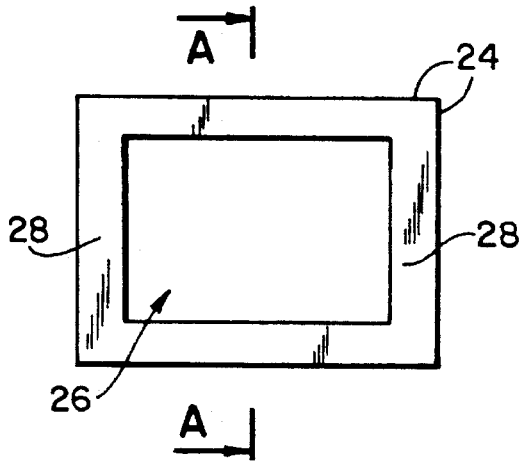
FIG. 3
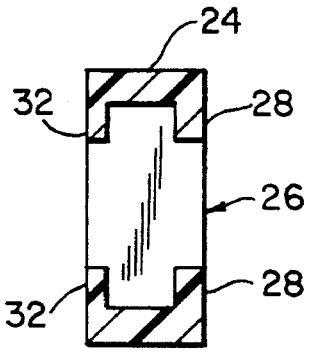
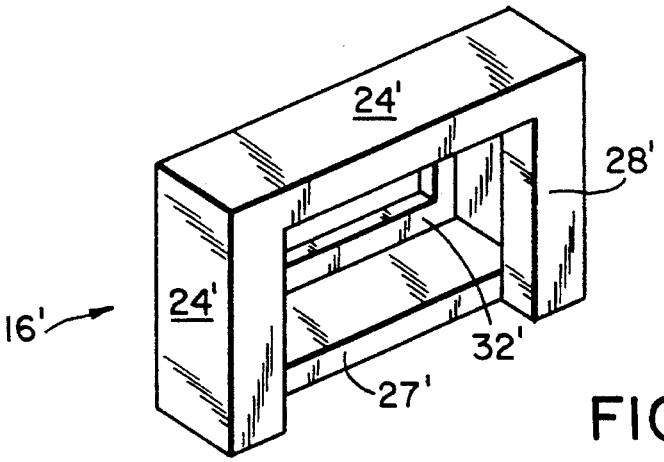
FIG. 4

PROTECTIVE IDENTIFYING SHIELD AND PROTECTED INSTRUMENT CASE

FIELD OF THE INVENTION

This invention relates generally to identification, and protection against physical damage, of instrument cases of the type having controls and visual displays mounted on a front panel, and more specifically relates to a distinctively identifying protective shield for the front panels of such instruments as well as to such instruments having protective identifying shields mounted thereon.

BACKGROUND OF THE INVENTION

Instruments, such as electronic meters, of the type enclosed in a generally rigid housing formed of metal or other suitable material, and having a front panel bearing visual displays and/or control devices in various combinations, are well known. Such instruments have been in general use in commercial, industrial and scientific applications for many years. In the most common configuration, the front panels of such instruments are rectangular in shape, and they are fastened to a rectangular box-like housing having side surface portions extending rearwardly from the four edges of the panel in substantially perpendicular relationship. Frequently, the periphery of the rear surface of the front panel is butted against the forward edges of the side surface portions of the housing, and fasteners such as screws pass through the front panel and engage threaded openings in the housing to clamp the panel and the housing together. Most often, a sealing gasket in the form of a rectangular band is clamped between the rear surface of the front panel and the forward edges of the side surface portions of the housing to seal the corresponding joint against entry of dust, moisture and the like.

In a well-known arrangement, a plurality of instruments are mounted in parallel and/or coordinate arrays with the front portion of each instrument projecting slightly forward of a generally planar display "board" that may be positioned vertically or inclined at an angle away from vertical. In other applications, one or more instruments may stand about on table tops or similar support surfaces, close to the sources of the electrical signals that are being controlled and/or displayed.

Applications of the type described above frequently involve substantial amounts of physical activity in relatively close proximity to one or more sensitive instruments. Under such circumstances, various objects being handled by operators, such as heavy tools, test specimens, industrial containers and even other electronic and mechanical instruments, frequently and unavoidably come into unintended contact with the exposed front panels of the instruments being used. The shocks, dents and other damage caused by such unintended contacts can result in substantial financial losses, not only through loss of the instruments themselves, but also through such consequences as lost or invalidated test results, incorrect readings of process control measurements and the like.

Protecting instruments from such damage is considered a highly desirable goal. In addition, especially in applications involving a plurality of instruments that are similar or identical in appearance, it is highly desirable to provide a means for being able to clearly and conveniently distinguish one instrument from another. The need to distinguish is particularly important where similar or identical instruments are reading or controlling signals that are significantly different from one another. In such circumstances, the consequences of mistaking the readings of one instrument for another can result in serious damage and costs.

Accordingly, it is an object of this invention to provide a protective shield for the front panel of electronic instruments and the like capable of absorbing shocks and impacts of unintended blows.

It is another object of this invention to provide a protective shield for the front panel of electronic instruments and the like that easily carries indicia for clearly and conveniently distinguishing one such instrument from another.

Another object of this invention is the provision of an electronic instrument having a front panel guarded by a protective identifying shield.

Another object of this invention is the provision of a protective shield for the front panel of an electronic instrument or the like, that can serve as both a seal between the front panel and an associated case that is mounted in a display board, and as a shield for protecting the case in part by transmitting unintended blows to the display board rather than to the instrument.

Still another object of this invention is the provision of a protective identifying shield for encased electronic equipment such as test instruments and the like that is simple and inexpensive to manufacture, and that can be installed and removed easily without special equipment or extensive labor.

BRIEF SUMMARY OF THE INVENTION

A feature of this invention is a protective shield in the form of a band of resiliently deformable and elastically stretchable material, shaped so that it can be stretch-fitted around the periphery of the front panel of an instrument in elastically gripping relationship.

Another feature of this invention is the provision of a protective shield of the type described in which the material of the shield is characterized by highly visible indicia such as distinctive color and or markings that permit ready identification of one shield and the instrument bearing it, relative to another such shield and/or instrument.

These and other and further objects, features and advantages of this invention will be made apparent to those having skill in this art by reference to the following specification and claims in association with the accompanying drawings, in which:

BRIEF DESCRIPTION OF THE DRAWINGS

FIG. 1 is a partially cut-away pictorial representation of an instrument protected by an identifying shield in accordance with this invention.

FIG. 2 is a front elevation view of an identifying protective shield in accordance with this invention.

FIG. 3 is a transverse cross-sectional view of the protective shield of FIG. 2, taken along line A—A of FIG. 2.

FIG. 4 is a pictorial representation of another embodiment of a protective identifying shield in accordance with this invention.

DETAILED DESCRIPTION OF THE INVENTION

Figure 5:
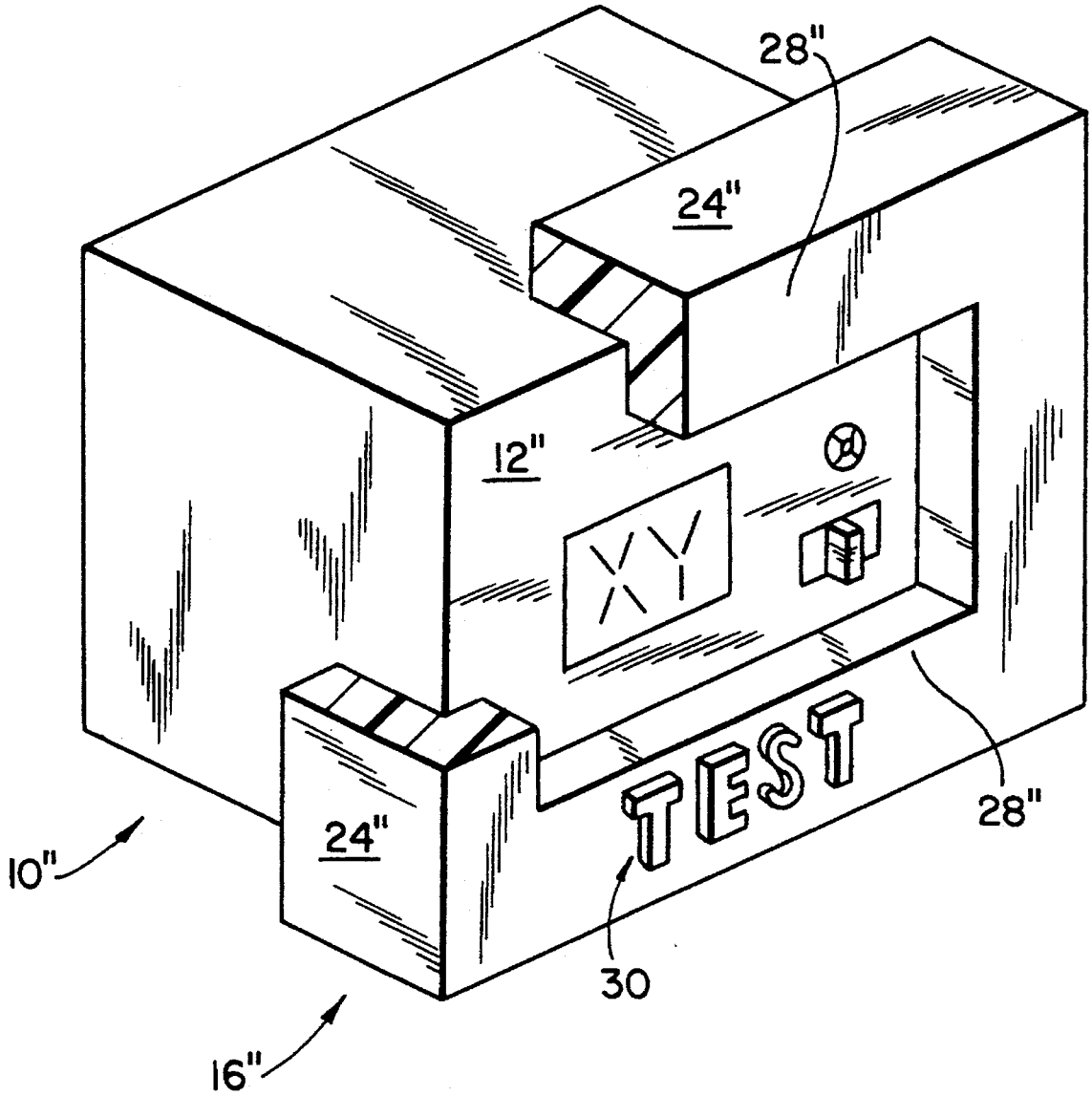
FIG. 5 is a partially cut-away pictorial representation of yet another embodiment of an instrument case protected by an identifying shield in accordance with this invention.

Referring now more specifically to the drawings FIG. 1 may be seen to illustrate an instrument case 10 having a front panel 12, side panel surface portions 14, and a protective shield 16 surrounding and overlying front panel 12 in peripheral engagement with side surface portions 14.

For purposes of illustration only, front panel 12 is shown to include a visual display 18, a slide switch 20 and an indicator light 22. It should be understood readily that these elements of the front panel 12 are intended solely to symbolize respectively the possible display, control and indicator functions of a typical instrument assembly; they are not intended to be regarded as a part of or limitation of any aspect of the invention.

The identifying protective shield 16 is formed of any readily available and suitable material that is both resiliently deformable and elastically stretchable. The material preferably should be easily molded by any commonly used manufacturing technique for ease of fabrication, and should be of a thermosetting nature as well, rather than thermoplastic, to resist more effectively, the heat energy and operating temperature characteristics of heat-generating electronic equipment with which it may be expected to be used.

Further in accordance with the objects of this invention, the material of shield 16 should be easily colored, preferably by coloring agents that are incorporated as a constituent of the material itself, in a wide variety of different and distinct colors. Color that is incorporated as a constituent of the material so that the color is relatively uniform throughout its body will enhance the identification function and effectiveness of the shield by helping to assure that nicks and other damage or other imperfections on the surface of the shield will not cause distracting loss of color or color variations in localized areas.

To enhance the identification function still further, the material of shield 16 should be easily moldable and preferably capable of retaining clear and relatively well-defined shapes in the manner of bas-relief sculpture, so that letters, numbers, symbols and other identifying indicia may be formed and clearly discerned on the surface of a formed shield, as shown for example, by the letters "T-E-S-T" at 30, in FIG. 5.

Referring again to the drawings, and specifically to FIG. 3, shield 16 may be seen to comprise generally a peripheral band 24 formed of the selected material, surrounding a central opening 26 which is configured to expose the front panel 12 of an instrument case 10 for ready access and viewing, as shown in FIG. 1. A first inwardly extending flange 28 projects inwardly toward opening 26 from a forward edge of band 24. A second inwardly extending flange 32 projects similarly toward opening 26 from a rearward edge of band 24 in spaced relation to the first flange 28. The thickness of flange 28 as well as the thickness of band 24 should be chosen in light of the resilience parameters of the material of the shield, to provide a desired degree of resilient cushioning protection for the underlying instrument case. Further, it should be recognized that the thickness of flange 28 defines a recess which positions the front panel 12 of an inserted instrument case 10 a given distance behind the forwardmost surface of the shield 16; the given distance is equal to the thickness of the flange 28, and this thickness therefore should be selected to provide whatever recess effect may be desired in a particular application.

FIG. 1 illustrates, in particular, the effect on rearward flange 32, of the peripheral elastic engagement of band 24 with the outer side surfaces 14 of an instrument case 10. Specifically, as the band 24 urges the base of flange 32 into engagement with a side surface 14, the deformable qualities of the shield material permits compression of the length of flange 32, while at the same time allowing band 24 to be bowed away from the surfaces 14 in response to the compression forces on flange 32. The result of this combined compression and bowing is a small space 34 adjacent to the inner surface of flange 32, as shown in FIG. 1. It has been found that the creation of this small space and the corresponding engagement of the lower inner edge 33 of flange 32 with side surface 14 of case 10 enhances the overall retention of shield 16 on case 10.

In FIGS. 1, 2 and 3 of the drawings, the flanges 28 and 32 are shown to extend in continuous peripheral relation around all sides of the opening 26; it should be understood, however, that either flange may be interrupted, if desired, and portions my be eliminated in whole or in part to accommodate special configurations of an instrument case, or to meet other specific requirements of particular applications, while remaining entirely within the meaning and intent of this invention.

For example, in FIG. 4, another embodiment of this invention comprises a shield 16', in which a lower forward portion of the first flange 28' has been removed to expose a forward edge 27' of peripheral band 24'. The forward edge 27' may be made as shown to lie substantially flush with the plane of the front panel 12 of an inserted instrument case 10, or it may be made to extend forwardly relative to the illustrated position so that it is more nearly flush with the frontmost surface of flange 28', to provide additional protection for the front panel 12 of an instrument case 10 without overlying or in any way obstructing the lower edge of the front panel.

FIG. 5 illustrates still another embodiment of this invention in which a shield 16" carried on an instrument case 10" comprises a peripheral band 24" and a first forwardly positioned flange 28" only, without a rearward flange. Elimination of the rearward flange facilitates assembly of the shield and the instrument case under some circumstances although it is recognized that some of the enhanced retention force advantages of the rear flange may be lost, as a result. The forward flange 28" surrounds and overlies the front panel 12" of the instrument case 10" in the manner previously described, while the shield is retained on the instrument case 10" solely by the peripheral elastic grip of band 24".

FIG. 5 further illustrates an added feature of this invention in the form of raised identifying indicia 30, here shown in the form of the letters "T-E-S-T". As explained previously herein, the indicia 30 may be molded into the body of the shield 16" during the fabrication process, and serve the purpose of allowing the shield and the instrument case with which it is associated to be identified easily and conveniently, independently of or in addition to the color of the shield.

Figure 6:
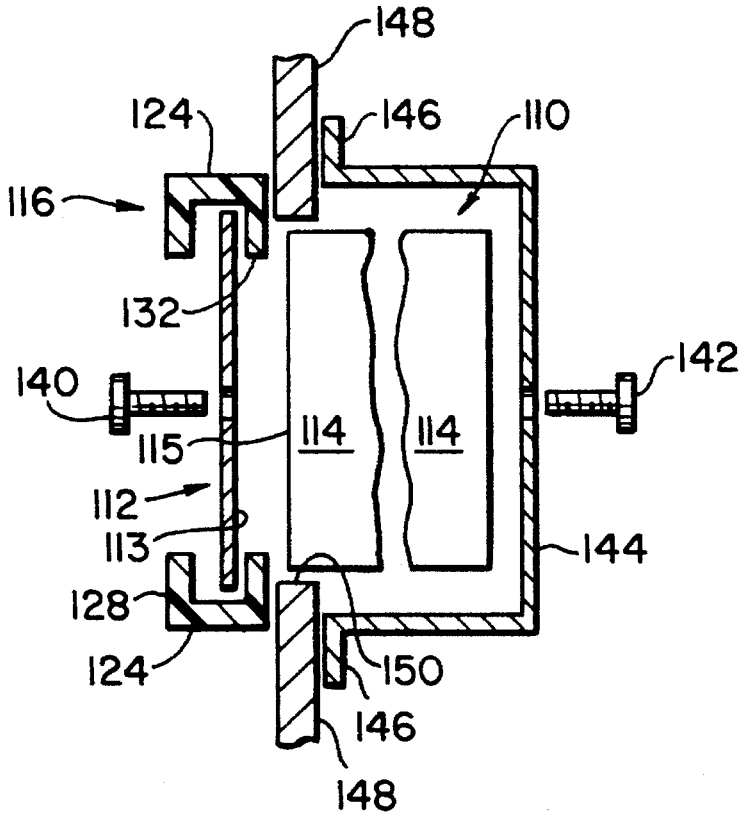
FIG. 6 is a partially exploded side cross-section view of a further embodiment of a shield and an instrument case in accordance with this invention, showing the shield and its associated instrument case as they would be mounted to a display board.

In the embodiment of the invention illustrated in FIG. 6, a protective shield 116 is secured to an instrument case 110 by clamping a rearward inwardly extending flange 132 between the rear surface 113 of a front panel 112 and the forward edges 115 of the side surface portions 114 of case 110. Mounting the shield 116 in this manner accomplishes two purposes, because it serves to capture the shield affirmatively to the case 110, and it also provides an integral resilient cushion and seal between the front panel 112 and the associated case or housing 110. This figure specifically illustrates an advantage of this invention associated with mounting of a protected instrument case within an opening 150 in a display board 148; in this arrangement, the shield 116 is dimensioned to be somewhat larger than the width and height dimensions of the instrument case 110, so that when the case is inserted into an opening such as 150 in a display board 148, the outer periphery of the shield forms a rearwardly projecting shoulder preventing the front panel of the case from passing thorough the opening. In this manner, the shoulder defined by the shield 116 abuts directly against the circumjacent surface of the display board 148; the shield may be held firmly in this position by any suitable mounting means such as the C-shaped yoke 144 of generally well-known design, which is clamped to the case 110 by a screw fastener 142. It should be understood that flange 132 of shield 116 may be captured, or clamped, between the rear surface of front panel 112 and the abutting surface of a display board 148, without being clamped between panel 112 and case 110. That is, the shield may, if desired, be elastically fitted around the projecting edges of panel 112 either before or after the panel is attached to the case 110.

To enhance and stabilize the mounting yoke 148, it may be provided with one or more "feet" 146, positioned and dimensioned to engage the rearward surface of the display board so as to support the yoke relative to the board in a manner which will be evident to those having skill in the art. When a mounted shield is held in place against an associated display board as shown, unintended shocks and blows received on the surface of the shield 116 will be transmitted in substantial part to the display board directly, rather than to the instrument case 110, thereby providing an enhanced measure of protection and isolation for the encased instrument.

To further enhance the protective function of the shield 116, the interior space between the forward flange 128 and the rearward flange 132 may be made greater than the thickness of front panel or bezel member 112, so that the forward flange will be spaced from and forward of the front surface of panel 112, thereby further isolating the panel and the instrument from unintended shocks and blows. However, it should be recognized also that the space between the forward flange 128 and the rearward flange 132 may desirably be made substantially equal to or slightly less than the thickness of front panel 112 so that the shield 116 will snugly engage the panel in snugly fitting relationship, within the scope of this invention. In this regard, it is simply required that at least some portions of the projecting edges of front panel 112 extend beyond the outer surfaces of the case 110 so as to form rearwardly projecting shoulders for engaging the forward surface of a display board 148.

Figure 7:
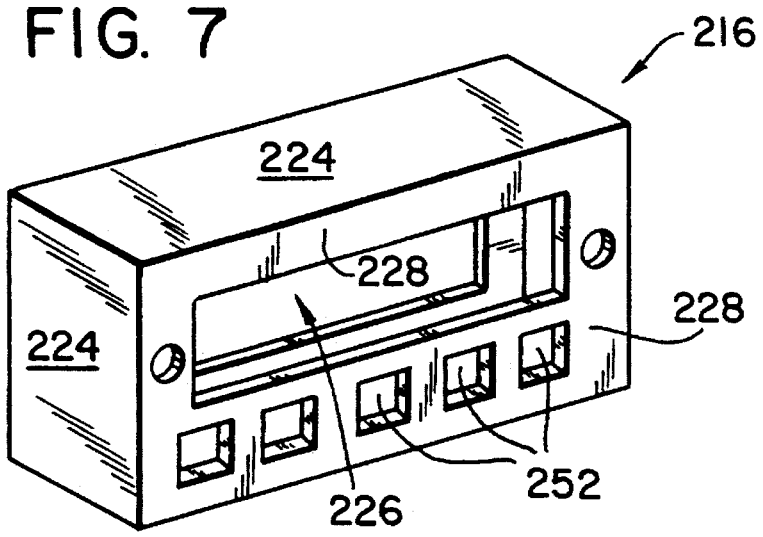
FIG. 7 is a pictorial representation of another embodiment of a shield in accordance with this invention.

In the further embodiment of a shield in accordance with this invention illustrated in FIG. 7, the forward inwardly extending flange 228 of a shield 216 extends as previously described, from a peripheral band 224 and includes an enlarged lower portion which is provided with one or more through openings 252. These are provided specifically to permit access to underlying parts of a front panel on which it is mounted; accordingly, the lower portion of the flange 228 is dimensioned to overly a greater portion of the front panel 112 than does, say, the upper portion of the same flange. It will be readily understood, as illustrated clearly in the drawing, that opening or openings 252 may supplement or entirely replace the central opening 226 without altering the function or operation of forward flange 228 in accordance with the disclosure of this invention.

Figure 8:
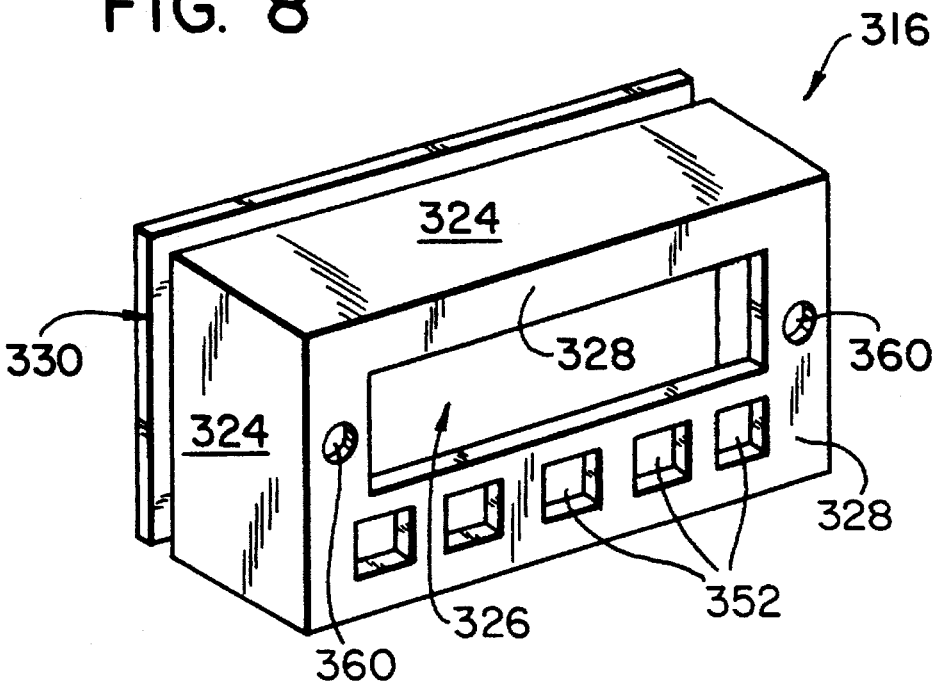
FIG. 8 is a pictorial representation of a shield in accordance with this invention adapted to be fabricated of substatially rigid material such as metal or plastic.
Figure 9:
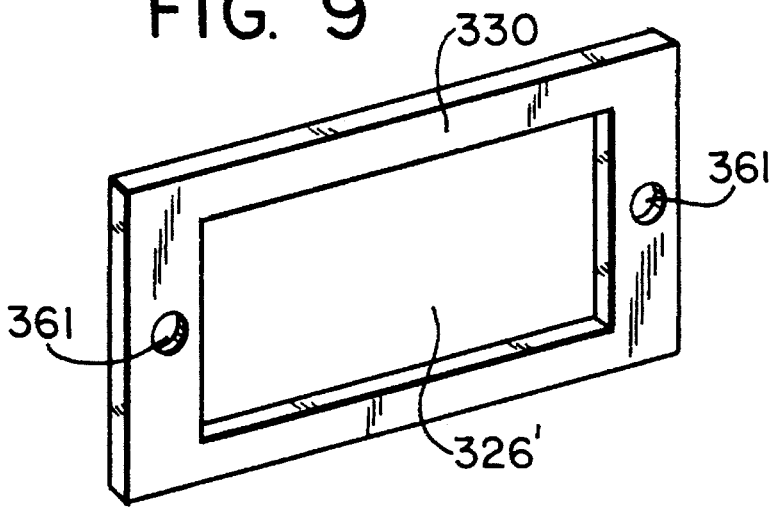
FIG. 9 is a pictorial representation of a backing plate shown partially in FIG. 8.

If desired, a shield in accordance with this invention may be made of substantially rigid material such as metal or any suitable plastic as shown at 316 in FIG. 8. As in the embodiment of FIG. 7, which it resembles the shield includes a forward flange 328 extending from a peripheral band 324, to overlie the front panel of an instrument case. A plurality of openings of desired shape 326, 352 give access to control or display devices on the front panel of an associated instrument. The finite thickness of flange 328 forms a recess of each opening 326, 352 to provide a shield for protecting associated elements on the front panel of an instrument from unintended blows or contact with foreign objects. At the same time, the rigid body of the shield protects the instrument from direct shocks when it is assembled with a display board in the general manner of FIG. 7. In one form, the shield 316 maybe attached directly to a display board by means of a backing plate 330, shown most clearly in FIG. 9. Suitable threaded fasteners not shown may be inserted through aligned openings 360 and 361 in the shield 316 and plate 330 respectively to clamp a display board between them in any obvious manner; openings 361 may be threaded for this purpose. Opening 326' in plate 330 may be dimensioned easily to permit an instrument case and its front panel to pass through from the rear of shield 316, for this purpose. Alternatively, shield 316 may be used without plate 330, and threaded fasteners (not shown) may pass through openings 360 to engage threaded holes in an instrument case of its front panel directly. Engagement of the rear edge of shield 316 with the surface of a display board, directly provided added protection for an instrument case by rigidly absorbing and/or transmitting applied forces directly to the display board.

What is claimed is:

1. A protected instrument case comprising:

an instrument housing having a front panel surface of given dimensions with side surface portions extending rearwardly from the edges of said front panel surface in substantially perpendicular relationship thereto;

a shield having a continuous peripheral band of resiliently deformable and elastically stretchable material defining a central opening having unstretched dimensions less than the said given dimensions of said front panel surface surrounding and elastically engaging the side surface portions of said instrument housing in stretched condition immediately adjacent to said front panel surface;

said peripheral band having a forward edge proximal said front panel surface and a rearward edge remote therefrom in a rearward direction;

said shield further having a first inwardly extending flange projecting from at least a portion of said forward edge of said peripheral band in substantially parallel, overlying relationship with the said front panel surface of said instrument housing and visible means on said shield providing a distinctive visual identification for distinguishing said shield from other shields and instruments.

2. A protected instrument case in accordance with claim 1, further comprising:

a second inwardly extending flange projecting from at least a portion of the rearward edge of said peripheral band, said second inwardly extending flange having an inner edge positioned in abutting frictional engagement with the adjacent side surface portion of said instrument housing.

3. A protected instrument case in accordance with claim 2, wherein:

a small vacant space exists adjacent to the inner surface of said second inwardly extending flange, between the side surface portion of said instrument housing the opposed inner surface of said peripheral band, due to compression of said second inwardly extending flange against the side surface portions of said instrument housing under the elastic forces of said peripheral band.

4. A protected instrument case in accordance with claim 2, wherein:

said shield is preformed in a substantially four-sided rectangular configuration having a generally open center, and said first inwardly extending flange projects from the forward edge of each one of the four sides thereof in substantially continuous array.

5. A protected instrument case in accordance with claim 4, wherein:

said second inwardly extending flange projects from the rearward edge of each one of the four sides of said shield in substantially continuous array.

6. A protected instrument case in accordance with claim 1, wherein:

said visible means comprises a distinctive color.

7. A protected instrument case in accordance with claim 1, wherein:

said visible means comprises distinctive markings formed in the body of said shield.

8. An identifying and protective shield for an instrument case having a housing with a front panel and side surface portions extending rearwardly from the edges of said front panel in substantially perpendicular relationship thereto, said shield comprising:

a unitary body portion in the form of a continuous peripheral band of resiliently deformable and elastically stretchable material for surrounding and elastically engaging the side surface portions of an instrument case immediately adjacent to its front panel surface, said peripheral band having a forward edge and a rearward edge;

a first inwardly extending flange projecting from at least a portion of the forward edge of said peripheral band to lie in substantially parallel, overlying relationship with the front panel of an instrument case;

a second inwardly extending flange projecting from at least a portion of the rearward edge of said peripheral band, said second inwardly extending flange having an inner edge for frictionally engaging the adjacent side surface portion of an instrument case and tending to create a confined space between the side surface portion of the instrument and a portion of the inner surface of said peripheral band immediately adjacent to said second inwardly extending flange; and visible means on said shield providing a distinctive visual identification for distinguishing said shield from other shields and instruments.

9. An identifying and protective shield in accordance with claim 8, wherein:

said visible means comprises a distinctive color.

10. An identifying and protective shield in accordance with claim 8, wherein:

said visible means comprises distinctive markings formed in the body of said shield.

11. An identifying and protective shield in accordance with claim 8, wherein:

said shield is preformed in a substantially four-sided rectangular configuration having a generally open center, and said first inwardly extending flange projects from the forward edge of each one of the four sides thereof in substantially continuous array.

12. An identifying and protective shield in accordance with claim 11, wherein:

said second inwardly extending flange projects from the rearward edge of each one of the four sides of said shield in substantially continuous array.

13. An identifying and protective shield in accordance with claim 8, wherein:

the thickness of said first inwardly extending flange defines a recess which locates the front panel surface of an inserted instrument in a recessed position rearwardly relative to the forwardmost outer surface of the said first inwardly extending flange.

14. An encased instrument comprising:

a housing having a front panel member with a forward surface and a rear surface, and a case with side surface portions extending rearwardly from said front panel in substantially perpendicular relationship thereto, said front panel being separably clamped to said case;

a peripheral band of resiliently deformable and elastically stretchable material surrounding and elastically engaging the periphery of said front panel member;

a first inwardly extending flange projecting from at least a portion of the forward edge of said peripheral band in substantially parallel, overlying relationship with the said forward surface of said front panel member;

a second inwardly extending flange projecting from at least a portion of the rearward edge of said peripheral band in spaced relation to said first inwardly extending flange, said second inwardly extending flange having an inner edge positioned in abutting clamped relationship between the said rear surface of said front panel member and said case to provide a seal therebetween.

15. An encased instrument in accordance with claim 14, wherein:

said peripheral band extends outwardly beyond the side surface portions of said case defining a rearwardly facing shoulder that may be abutted against the surrounding surface of an opening in a display board in which the said instrument is inserted to transmit forces from said peripheral band to said display board.

16. An encased instrument in accordance with claim 14, wherein:

said first inwardly extending flange is positioned in overlying relationship with said forward surface of said front panel member and spaced forwardly thereof to define a protective bumper for the said forward surface.

17. An encased instrument in accordance with claim 14, wherein:

said first inwardly extending flange includes at least one opening therethrough providing access to an underlying area of said front panel.

* * * * *